US007522142B2

(12) United States Patent
Song

(10) Patent No.: US 7,522,142 B2
(45) Date of Patent: Apr. 21, 2009

(54) GATE DRIVER, LIQUID CRYSTAL DISPLAY DEVICE AND DRIVING METHOD THEREOF

(75) Inventor: Byung Chan Song, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 529 days.

(21) Appl. No.: 11/022,991

(22) Filed: Dec. 28, 2004

(65) Prior Publication Data

US 2005/0156861 A1 Jul. 21, 2005

(30) Foreign Application Priority Data

Dec. 30, 2003 (KR) ..... 10-2003-0099579

(51) Int. Cl.
*G09G 3/36* (2006.01)

(52) U.S. Cl. ..... 345/98; 345/100

(58) Field of Classification Search ..... 345/87–100
See application file for complete search history.

(56) References Cited

U.S. PATENT DOCUMENTS

| | | | | |
|---|---|---|---|---|
| 5,689,280 | A * | 11/1997 | Asari et al. | 345/89 |
| 5,745,092 | A * | 4/1998 | Ito | 345/95 |
| 6,052,103 | A * | 4/2000 | Fujiwara et al. | 345/89 |
| 6,072,450 | A * | 6/2000 | Yamada et al. | 345/76 |
| 6,445,372 | B1 * | 9/2002 | Asai | 345/99 |
| 7,126,597 | B2 * | 10/2006 | Shino et al. | 345/100 |

* cited by examiner

*Primary Examiner*—Kevin M Nguyen
(74) *Attorney, Agent, or Firm*—McKenna Long & Aldridge LLP

(57) ABSTRACT

A liquid crystal display device includes: a liquid crystal panel having gate lines and data lines, the gate lines and the data lines defining pixels; a gate driver for providing scan signals to the gate lines of the liquid crystal panel; and a data driver for providing video data to the data lines of the liquid crystal panel. The gate driver outputs a high-potential gate voltage to one gate line and outputs a low-potential gate voltage to the remaining gate lines. An output current of the low-potential gate voltage is different from that of the high-potential gate voltage.

25 Claims, 4 Drawing Sheets

GATE DRIVER, LIQUID CRYSTAL DISPLAY DEVICE AND DRIVING METHOD THEREOF

This application claims the benefit of Korean Patent Application No. 2003-99579 filed on Dec. 30, 2003 which is hereby incorporated by reference for all purposes as if fully set forth herein.

BACKGROUND OF THE INVENTION

1. Field of the Invention

The present invention relates to a liquid crystal display device, and more particularly, to a gate driver, a liquid crystal display device and a driving method thereof capable of preventing a crosstalk.

2. Description of the Related Art

Liquid crystal display devices (LCD) have a number of advantages, such as a low voltage driving signal, a low power consumption, a slim profile, light weight, and full color reproduction. LCDs are widely used as display windows of watches and calculators, computer monitors, television (TV) sets, TV monitors, and mobile telephones.

In the LCD device, liquid crystals are injected into a liquid crystal panel and controlled to selectively transmit a light emitted from a light source. In this manner, predetermined images are displayed.

However, crosstalk causing an abnormal display characteristic occurs when the LCD is driven. The crosstalk is a phenomenon that when white data or black data is concentrated on a specific liquid crystal cell, original gray-scale levels of liquid crystal cells adjacent to that specific liquid crystal cell in four directions are influenced by the gray-scale level of the specific liquid crystal cell, so that different gray-scale levels are displayed. Vertical crosstalk occurs in the liquid crystal cells disposed up and down from the specific liquid crystal cell, and horizontal crosstalk occurs in the liquid crystal cells disposed to the right and left of the specific liquid crystal cell. The vertical crosstalk occurs when the TFTs are not sufficiently electrically turned off. That is, vertical crosstalk occurs when unintended gray-scale voltages are transmitted through the TFTs that are not sufficiently electrically turned off. The horizontal crosstalk occurs due to variations in the potential of the common electrode. That is, when the gray-scale voltage is charged to liquid crystal cells adjacent in the horizontal direction to an arbitrary liquid crystal cell, an accurate gray-scale level is not supplied to an arbitrary liquid crystal cell due to an influence of the potential of the common electrode, resulting in the horizontal crosstalk.

FIG. 1A is an ideal operation waveform of an LCD, and FIG. 1B is an actual operation waveform of an LCD.

Referring to FIG. 1A, in an ideal state, there are no stray capacitance of the TFT (that is, a parasitic capacitance between a source terminal and a drain terminal, a parasitic capacitance between a source terminal and a gate terminal, and a parasitic capacitance between a gate terminal and a drain terminal), no parasitic capacitance between a source terminal and a gate terminal, and no parasitic capacitance between a gate terminal and a gate line adjacent thereto. Also, a common voltage supplied to a common electrode is constantly maintained by a direct current (DC).

Accordingly, the TFTs are turned on at a transition from a low-potential gate voltage Voff to a high-potential gate voltage Von. Then, data voltages are charged to the respective pixels through data lines and TFTs. Also, the TFTs are turned off at a transition from the high-potential gate voltage Von to the low-potential gate voltage Voff, and the charged voltages of the pixels are maintained as the data voltages. In this case, the data voltages supplied to the pixels are identical to the pixel voltages Vpixel applied to the pixels. Thus, there exists no stray capacitance at the ideal state and the common voltage is not changed, such that the crosstalk does not occur.

In actual practice, however, stray capacitance does exist in the TFT. Also, the common voltage supplied to the common electrode is changed.

In such a case, as shown in FIG. 1B, an unintended stray capacitance occurs in the TFT at a transition from a high-potential gate voltage Von to a low-potential gate voltage Voff. Due to the stray capacitance, a distortion occurs in the common voltage Vcom and the low-potential gate voltage Voff. Due to the distortion in the common voltage and the low-potential gate voltage, the data voltages supplied to the pixels are dropped and the decreased pixel voltages Vpixel are charged to the pixels. Thus, the crosstalk is caused by the decreased pixel voltages Vpixel.

In general, an intensity of the crosstalk is largely dependent of the variations in the common voltage and the low-potential gate voltage. A technology for maximally suppressing the variation of the common voltage so as to prevent the crosstalk is widely used.

As described above, however, the crosstalk is sensitive to the variation in the low-potential gate voltage as well as the variation in the common voltage. Therefore, even though the variation in the common voltage is suppressed, the crosstalk cannot be completely prevented. A method capable of preventing the crosstalk by suppressing the variation in the low-potential gate voltage has not been proposed in the related art. Accordingly, there is a demand for a method capable of preventing crosstalk by controlling the variation in the low-potential gate voltage.

SUMMARY OF THE INVENTION

Accordingly, the present invention is directed to a gate driver, a liquid crystal display device and a driving method thereof that substantially obviate one or more problems due to limitations and disadvantages of the related art.

An object of the present invention is to provide a gate driver, a liquid crystal display device and a driving method thereof, capable of preventing a crosstalk by controlling a variation of a low-potential gate voltage.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a liquid crystal display device including: a liquid crystal panel having gate lines and data lines, the gate lines and the data lines defining pixels; a gate driver for providing scan signals to the gate lines of the liquid crystal panel; and a data driver for providing video data to the data lines of the liquid crystal panel, wherein the gate driver outputs a high-potential gate voltage to one gate line and outputs a low-potential gate voltage to the remaining gate lines, an output current of the low-potential gate voltage being different from that of the high-potential gate voltage.

The gate driver may include: a gate shift register configured with a plurality of flip-flops for sequentially outputting predetermined control signals; an AND operation unit configured with a plurality of AND gates corresponding to the plurality of flip-flops, for controlling the output of the control signals sequentially outputted from the flip-flops in response to a gate output enable signal; a level shifter configured with a plurality of sub-level shifters corresponding to the plurality of AND gates, for leveling a predetermined voltage according to the output signals of the AND gates; and a buffer unit configured with a plurality of output buffers corresponding to the plurality of sub-level shifters, for outputting the leveled voltages having different output current in response to the control signals sequentially outputted from the flip-flops.

Each of the output buffers may include: a comparator for comparing the control signal with a reference value and outputting a predetermined output value; and an amplifier for outputting a leveled voltage having an output current selected depending on the output value of the comparator.

Each of the output buffers may include: an amplifier for amplifying the leveled voltage, a high power current being previously set to the amplifier; a lowering means resistor coupled to the amplifier, for lowering the high power current to a low power current; and a switch coupled in parallel to the lowering means, for controlling a path of the high power current.

In another aspect of the present invention, there is provided a method for driving a liquid crystal display device, including: generating first and second drive control signals using a synchronization signal contained in video data, the drive control signals including a gate shift clock, a gate start pulse and a gate output enable signal; outputting a predetermined gate voltage to gate lines of a liquid crystal panel in response to the first drive control signal; providing the video data to data lines of the liquid crystal panel in response to the second drive control signal; and displaying the video data according to scan signal, wherein if a high-potential gate voltage is outputted to one gate line, a low-potential gate voltage is outputted to the remaining gate lines, an output current of the low-potential gate voltage being different from that of the high-potential gate voltage.

The operation of outputting the predetermined gate voltage may include: outputting the gate start pulse in response to the gate shift clock; leveling a predetermined voltage according to the gate start pulse; selecting different output currents depending on the gate star pulse; and outputting the leveled voltages having the selected output currents.

In a further exemplary aspect of the present invention, there is provided a gate driver for driving a liquid crystal panel having gate lines and data lines, the gate lines and the data lines defining pixels, the gate driver including: a gate shift register configured with a plurality of flip-flops for sequentially outputting predetermined control signals; an AND operation unit configured with a plurality of AND gates corresponding to the plurality of flip-flops, for controlling the output of the control signals sequentially outputted from the flip-flops in response to a gate output enable signal; a level shifter configured with a plurality of sub-level shifters corresponding to the plurality of AND gates, for leveling a predetermined voltage according to the output signals of the AND gates; and a buffer unit configured with a plurality of output buffers corresponding to the plurality of sub-level shifters, for outputting the leveled voltages having different output current in response to the control signals sequentially outputted from the flip-flops.

The plurality of output buffers correspond to the gate lines of the liquid crystal panel, and if a high-potential gate voltage is outputted from one of the plurality of output buffers, a low-potential gate voltage is outputted from the remaining output buffers, an output current of the low-potential gate voltage being different from that of the high-potential gate voltage.

The control signals are classified into a first control signal having a high level and a second control signal having a low level. The first control signal is outputted from only one flip-flop among the plurality of flip-flops, and the second control signal is outputted from the remaining flip-flops.

One output buffer among the plurality of output buffers outputs a high-potential gate voltage having a low power current in response to the first control signal, and the remaining output buffers output a low-potential gate voltage having a high power current in response to the second control signal.

One output buffer among the plurality of output buffers outputs a high-potential gate voltage having a high power current in response to the first control signal, and the remaining output buffers output a low-potential gate voltage having a low power current in response to the second control signal.

The plurality of output buffers output a high-potential gate voltage having a low power current in response to the first control signal and output a low-potential gate voltage having a high power current in response to the second control signal.

The plurality of output buffers output a high-potential gate voltage having a high power current in response to the first control signal and output a low-potential gate voltage having a low power current in response to the second control signal.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to embodiments of the present invention, examples of which are illustrated in the accompanying drawings. Wherever possible, the same reference numbers will be used throughout the drawings to refer to the same or like parts.

First, an overall structure of an LCD will be described with reference to FIG. 2.

Figure 1A:
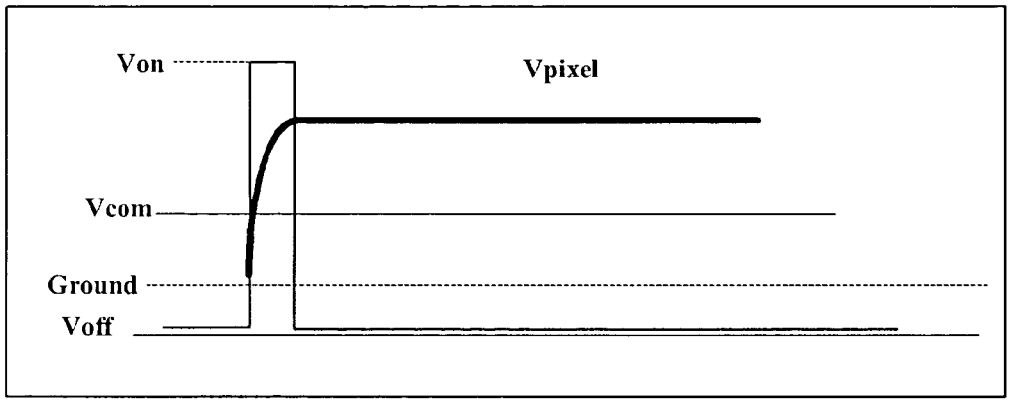
FIG. 1A is an ideal operation waveform of an LCD.
Figure 1B:
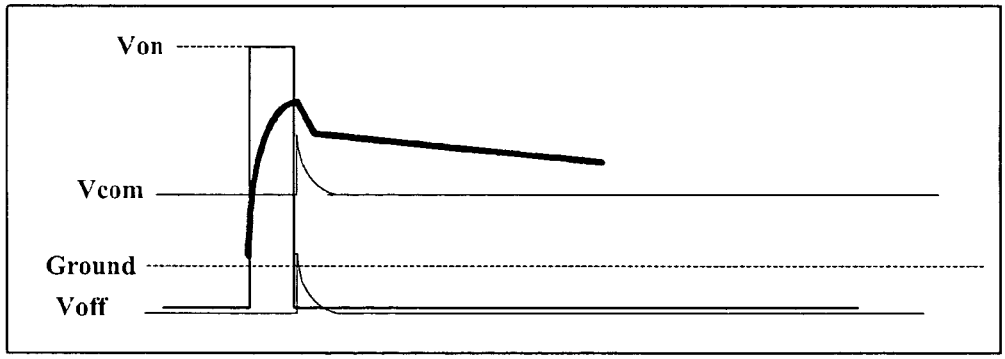
FIG. 1B is an actual operation waveform of an LCD.
Figure 2:
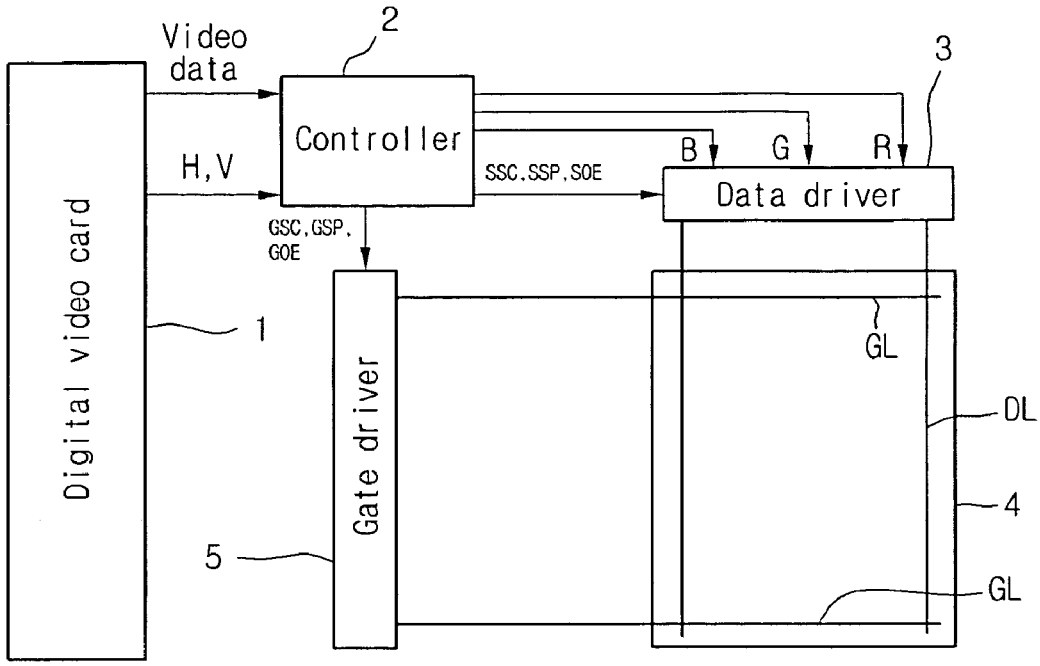
FIG. 2 is a schematic view of an LCD according to the present invention.

FIG. 2 is a schematic view of an LCD according to the present invention.

Referring to FIG. 2, an LCD according to the present invention includes a digital video card 1, a controller 2, a gate driver 5, a data driver 3, and a liquid crystal panel 4.

The digital video card 1 receives analog video data from an outside (for example, a computer main body, a digital versatile disc (DVD) player, etc.) and converts the analog video signal into a digital video signal. The digital video card 1 detects a vertical synchronization signal (Vsync) and a horizontal synchronization signal (Hsync) from the analog video signal. The digital video data, the Vsync signal and the Hsync signal are transmitted to the controller 2.

Using the Vsync signal and the Hsync signal transmitted from the digital video card 1, the controller 2 generates a drive control signal that controls timing for driving the liquid crystal display 4. The drive control signal includes first drive control signals GSC, GSP and GOE and second drive control signals SSC, SSP and SOE. The first drive control signals GSC, GSP and GOE are used to generate scan signals provided to gate lines GL of the liquid crystal panel 4, and the second drive control signals SSC, SSP and SOE are used to control timings of data signals provided to data lines DL of the liquid crystal panel 4. The first drive control signal is provided to the gate driver 5 and the second drive control signal is provided to the data driver 3 together with the digital video data. The first drive control signals may include a gate shift clock (GSC), a gate start pulse (GSP) and a gate output enable (GOE). The second drive control signals may include a source shift clock (SSC), a source start pulse (SSP) and a source output enable (SOE).

The gate driver 5 sequentially provides predetermined scan signals to the gate lines GL of the liquid crystal panel 4 according to the first drive control signals. The scan signals include a high-potential gate voltage Von. Thin film transistors (TFTs) of the liquid crystal panel 4 can be turned on in response to the high-potential gate voltage Von. The high-potential gate voltage has a predetermined pulse width. A low-potential gate voltage Voff means a non-scan signal. The TFTs can be turned off in response to the low-potential gate voltage. In the following discussion, the scan signal and the non-scan signal will be referred to as the high-potential gate voltage and the low-potential gate voltage, respectively.

In response to the second drive control signals, the data driver 3 converts the digital video data into a gray-scale data voltage according to a predefined gamma value. Then, the data driver 3 provides the gray-scale data voltage to the data lines DL of the liquid crystal panel 4.

The liquid crystal panel 4 includes an array substrate, a color filter substrate, and a liquid crystal layer. A plurality of gate lines, a plurality of data lines, a plurality of TFTs, and a plurality of pixel electrodes are arranged on the array substrate. A black matrix, R, G, B color filters, and a common electrode are arranged on the color filter substrate. The liquid crystal layer is interposed between the array substrate and the color filter substrate. In the array substrate, the gate lines are arranged perpendicular to the data lines, and the TFTs are arranged at intersections of the gate lines and the data lines. Also, the TFTs are coupled to the pixel electrodes.

The high-potential gate voltage provided from the gate driver 5 is applied to only one gate line and the low-potential gate voltage is applied to the remaining gate lines. Since the high-potential gate voltage is sequentially applied to the gate lines of the liquid crystal panel, one-time high-potential gate voltage may be supplied to each gate line during one frame. Thus, the high-potential gate voltage is sequentially applied to each gate line at every specific time points during one frame, such that the TFTs coupled to each gate line are turned on. After a predetermined time, the low-potential gate voltage is applied and thus the TFTs are turned off.

The TFTs coupled to the gate lines are turned on in response to the high-potential gate voltage applied to the gate lines at a predetermined time point. The gray-scale data voltages from the data driver 3 are applied to the pixel electrodes through the turned-on TFTs. The liquid crystals of the liquid crystal layer are controlled by an electric field, which is induced between the gray-scale data voltage applied to the pixel electrodes and the common voltage applied to the common electrode. In this manner, predetermined images are displayed.

In the above-described LCD, when each gate line changes from the high-potential gate voltage Von to the low-voltage gate voltage Voff, the common voltage and the low-potential gate voltage Voff are changed due to the stray capacitance of the TFT. These changes may cause the crosstalk.

The crosstalk can be prevented by suppressing a variation of the common voltage or a variation of the low-potential gate voltage.

In one exemplary embodiment, the crosstalk can be prevented by suppressing the variation of the low-potential gate voltage.

In order to suppress the variation of the low-potential gate voltage, an output intensity (current) of the gate driver 5 must be controlled.

In the related art gate driver, however, the output intensity is fixed in advance. That is, because each output buffer of the related art gate driver is fixed to the same output intensity, the low-potential or high-potential voltage having the fixed output intensity is outputted without regard to the low-potential or high-potential gate voltage. Thus, it is very difficult in the related art to suppress the variation of the low-potential gate voltage, which is caused by the stray capacitances of the TFTs. As a result, the crosstalk is caused.

Figure 3:
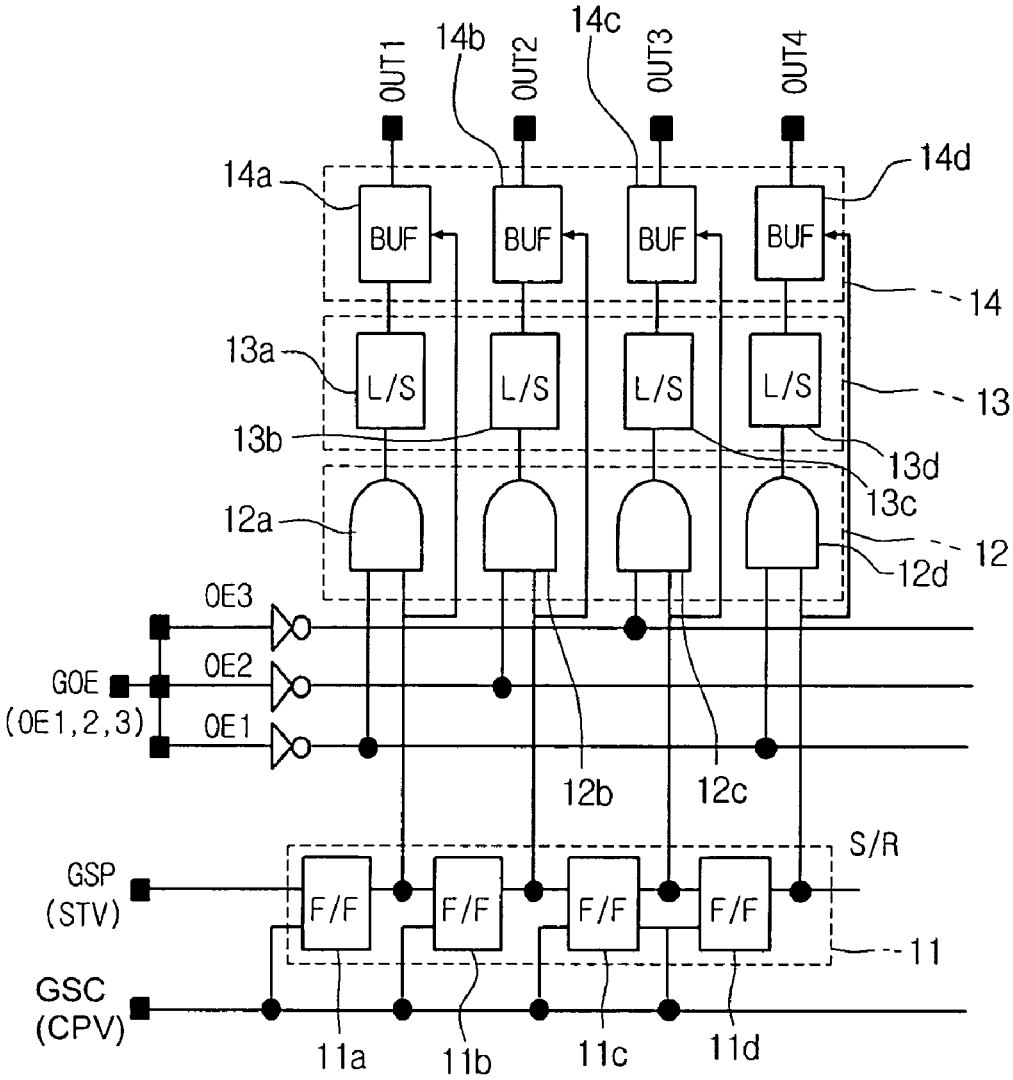
FIG. 3 is a circuit diagram of a gate driver illustrated in FIG. 2.

The present invention can prevent the crosstalk by controlling the output intensity of each output buffer 14*a* to 14*d* included in the gate driver 5 differently, as illustrated in FIG. 3.

FIG. 3 is a circuit diagram of the gate driver illustrated in FIG. 2.

Referring to FIGS. 2 and 3, the gate driver 5 includes a gate shift register 11, an AND operation unit 12, a level shifter 13, and a buffer unit 14. The gate shift register 11 includes a plurality of flip-flops 11*a* to 11*d*, and the AND operation unit 12 includes a plurality of AND gates 12*a* to 12*d*. The level shifter 13 includes a plurality of sub-level shifters 13*a* to 13*d*, and the buffer unit 14 includes a plurality of output buffers 14*a* to 14*d*. The flip-flops 11*a* to 11*d*, the AND gates 12*a* to 12*d*, the sub-level shifters 13*a* to 13*d*, and the output buffers 14*a* to 14*d* are correspondingly coupled to the gate lines of the liquid crystal panel 4.

For example, the first flip-flop 11*a* of the gate shift register 11, the first AND gate 12*a* of the AND operation unit 12, the first sub-level shifter 13*a* of the level shifter 13 and the first output buffer 14*a* of the buffer unit 14 are coupled to the first gate line of the liquid crystal panel. Likewise, the second flip-flop 11*b* of the gate shift register 11, the second AND gate 12*b* of the AND operation unit 12, the second sub-level shifter 13*b* of the level shifter 13 and the second output buffer 14*b* of the buffer unit 14 are coupled to the second gate line of the liquid crystal panel.

The gate shift register 11 shifts and sequentially outputs the GSP signal in response to the GSC signal. The GSC signal has an on-pulse in clock unit. A first on-pulse will be referred to as a first GSC signal, and a second on-pulse will be referred to as a second GSC signal. The first flip-flop 11*a* of the gate shift register 11 outputs the GSP signal in response to the first GSC signal and simultaneously provides it to the second flip-flop 11*b*. The second flip-flop 11*b* outputs the GSP signal in response to the second GSC signal and simultaneously provides it to the third flip-flop 11*c*. In this manner, every when the GSC signal is applied, the GSP signal is sequentially outputted from the flip-flops 11*a* to 11*d*. At this point, the first flip-flop 11*a* which is outputting the GSP signal in response to the first GSC signal does not output the GSP signal when the second GSC signal is applied. Of course, even though the next GSC signals are applied in sequence, the first flip-flop 11*a* does not output the GSC signal during one frame any more. As a result, each flip-flop 11*a* to 11*d* outputs the GSP signal as short as one on-pulse width of the GSC signal during one frame.

The AND operation unit 12 controls whether to output the signals that are sequentially outputted from the gate shift register 11 according to the GOE signal. The GOE signal consists of combination of coding values. The AND gates 12*a* to 12*d* of the AND operation unit 12 are controlled by the combination of the coding values. The GOE signal is propagated through NOT gates to the AND gates 12*a* to 12*d*. Thus, the GOE signal is inverted by the NOT gate. For example, if the first GOE signal is 100 (in the order of GOE1, GOE2 and GOE3), the first GOE signal is inverted by the NOT gates so that it becomes 011. Then, the inverted first GOE signal is inputted to the AND gates 12*a* to 12*d*. Accordingly, the GSP signal from the gate shift register 11 is outputted through the first AND gate 12*a*. If the second GOE signal is 010, the GSP signal is outputted through the second AND gate 12*b*. If the third GOE signal is 001, the GSP signal is outputted through the third AND gate 12*c*.

The level shifter 13 levels the GSP signal of the AND operation unit 12 to a predetermined voltage. That is, the level shifter 13 levels the GSP signal outputted from one of the AND gates 12*a* to 12*d* to a high-potential gate voltage. At this point, the remaining AND gates do not output the GSP signal. If the GSP signal is not outputted, the level shifter 13 levels the signal to a low-potential gate voltage. Accordingly, a specific sub-level shifter 13*a* of the level shifter 13 levels the signal to the high-potential gate voltage during a period corresponding to the GSC signal of one clock in one frame, and it levels the signal to the low-potential gate voltage during the remaining frame.

The buffer unit 14 amplifies the gate voltage outputted from the level shifter 13 and outputs it to a corresponding gate line. At this point, two different output intensities (current values), that is, a high power current and a low power current, may be set to each of the output buffers 14*a* to 14*d* of the buffer unit 14. Although two different output currents are set in this embodiment, a plurality of currents can be set if necessary.

The output intensity of the buffer unit 14 may change depending on the GSP signal outputted from the gate shift register 11. The GSP signal will be referred to as a control signal.

In the related art, the same fixed output current is set to the respective output buffers of the buffer unit. Accordingly, when the high-potential gate voltage or the low-potential gate voltage is supplied, the fixed output current is outputted. Because of this, if the fixed output current is outputted without regard to the high-potential gate voltage or the low-potential gate voltage, distortion occurs when the low-potential gate voltage is outputted. The crosstalk is caused by the distortion due to the low-potential gate voltage.

In the present invention, two different set currents are set to the respective output buffers 14*a* to 14*d* of the buffer unit 14. At this point, the different output currents are outputted depending on the control signal, which is outputted from the gate shift register 11.

Alternatively, by adding resistors to the buffer unit 14, different output currents can be outputted depending on the passing through the resistors.

Only one of the flip-flops 11*a* to 11*d* outputs the control signal in response to one-clock GSP signal. For example, when the control signal is outputted from the first flip-flop 11*a* of the gate shift register 11, the remaining flip-flops 11*b* to 11*d* do not output the control signal. Also, when the control signal is outputted from the second flip-flop 11*b* of the gate shift register 11, the remaining flip-flops 11*a*, 11*c* and 11*d* do not output the control signal. At this point, the control signal from the first flip-flop 11*a* is outputted by the control of the GOE signal, and then leveled to the high-potential gate voltage by the first sub-level shifter 13*a*, and then applied to the first gate line of the liquid crystal panel 4 through the first output buffer 14*a*. In this case, the remaining flip-flops 11*b* to 11*d* do not output the control signal and the signal is leveled to the low-potential gate voltage by the corresponding sub-level shifters 13*b* to 13*d*, and then applied to the corresponding gate lines through the corresponding output buffers 14*b* to 14*d*.

In the present invention, the output current of the buffer unit can be controlled in two types depending on characteristic modes of the liquid crystal panel. The characteristic mode of the liquid crystal panel includes Twisted Nematic (TN) mode, In-Plane Switching (IPS) mode, Super Twisted Nematic (STN) mode, Vertical Alignment (VB) mode, Ferroelectric Liquid Crystal (FLC) mode, Electrically Controlled Birefringence (ECB) mode, and so on.

In a first case, when the high-potential gate voltage having the high power current is outputted to a specific gate line, the low-potential gate voltage having low power current is outputted to the remaining gate lines.

In a second case, when the high-potential gate voltage having the low power current is outputted to a specific gate line, the low-potential gate voltage having high power current is outputted to the remaining gate lines.

A method for controlling the output current according to the two cases will now be described.

<Case 1>

In the first case, when the high-potential gate voltage having the high power current is outputted to a specific gate line, the low-potential gate voltage having the low power current is outputted to the remaining gate lines.

First Exemplary Embodiment

Figure 4:
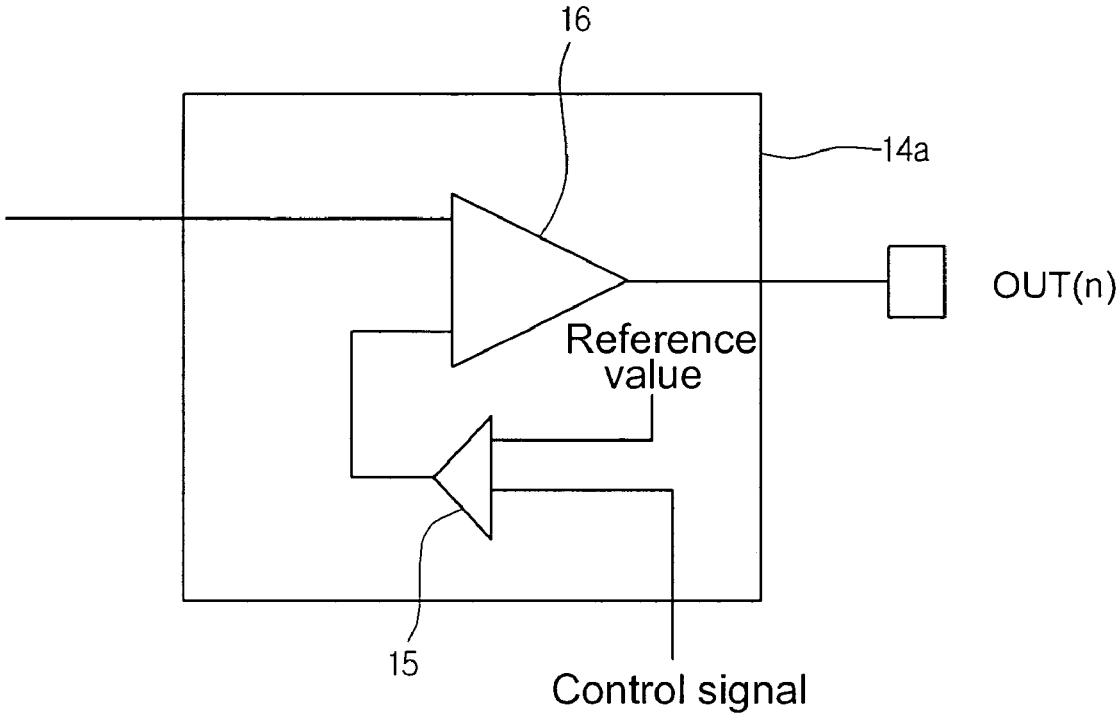
FIG. 4 is a circuit diagram of an output buffer illustrated in FIG. 3 according to an embodiment of the present invention.

FIG. 4 is a circuit diagram of the output buffer illustrated in FIG. 3. In FIG. 4, one among the plurality of output buffers 14*a* to 14*d* included in the buffer unit 14 is illustrated. An input terminal of the first output buffer 14*a* is coupled to an output terminal of the first sub-level shifter 13*a* and an output terminal of the first flip-flop 11*a*, and an output terminal of the first output buffer 14*a* is coupled to the first gate line. Accordingly, the predetermined gate voltage from the first sub-level shifter 13*a* and the control signal from the first flip-flop 11*a* are inputted to the first output buffer 14*a*, and the gate voltage having a different output current according to the control signal is outputted to the first gate line.

The output buffer 14*a* includes a comparator 15 for comparing the control signal of the first flip-flop 11*a* with a reference value to output a predetermined output value, and an amplifier 16 for selecting an output current corresponding to the output value of the comparator 15 and outputting it to the first gate line together with the gate voltage outputted from the first sub-level shifter 13*a*. The reference value may be set to 0 V. Such a circuit configuration may be applied equally to all the output buffers 14*a* to 14*d* of the buffer unit 14. For example, if the control signal is outputted from the first flip-flop 11*a*, it is 3.3 V, and when the control signal is not outputted from the first flip-flop 11*a*, it is 0 V.

When the control signal of 3.3 V is outputted from the first flip-flop 11*a*, the control signal of 3.3 V is outputted to the first output buffer 14*a* and the first AND gate 12*a*. The control signal outputted to the first AND gate 12*a* is outputted according to the GOE signal, leveled to the high-potential gate voltage by the first sub-level shifter 13*a*, and then inputted to the amplifier 16 of the first output buffer 14*a*.

The comparator 15 compares the control signal of 3.3 V and the reference value of 0 V. If the control signal is different from the reference value, a value of "1" is outputted to the amplifier 16. If the control signal is equal to the reference value, a value of "0" is outputted to the amplifier 16.

Two different output currents, the high power current and the low power current, are previously set in the amplifier 16. For example, the high power current may be approximately 10 mA and the low power current may be approximately 5 mA.

The output current can be differently selected depending on the output value of the comparator 15. For example, when the output value of the comparator 15 is "0", the low power current of 5 mA is selected, and when the output value of the comparator is "1", the high power current of 10 mA is selected.

The amplifier 16 selects the output current according to the output value of the comparator 15, and then outputs it together with the gate voltage outputted from the first sub-level shifter 13*a*.

As described above, when the high-potential gate voltage is outputted to the first gate line, the low-potential gate voltage is outputted to the remaining gate lines.

For this purpose, the control signal of 3.3 V is outputted from the first flip-flop 11*a*. The control signal of 3.3 V is inputted to the first AND gate 12*a* and the comparator 15. The first AND gate 12*a* outputs the control signal to the first sub-level shifter 13*a* in response to the GOE signal. The first sub-level shifter 13*a* levels the control signal to the high-potential gate voltage and then outputs it to the amplifier 16. Meanwhile, the comparator 16 of the first output buffer 14*a* compares the control signal (in this case, 3.3 V with the reference value of 0V. Because the control signal is different from the reference value, the comparator 15 outputs the value of "1" to the amplifier 16. The comparator 16 selects the high power current corresponding to the output value of "1" and outputs it to the first gate line together with the high-potential gate voltage. At this point, the low-potential gate voltage is outputted to the remaining gate lines. That is, the flip-flops 11*b* to 11*d* except the specific flip-flop 11*a* do not output the control signal. In other words, the control signal of 0 V is outputted from the remaining flip-flops 11*b* to 11*d*. Accordingly, the control signal of 0 V is inputted to the comparators 15 of the output buffers 14*b* to 14*d* and the AND gates 11*b* to 11*d*, which are coupled to the flip-flops 11*b* to 11*d*. The respective AND gates 12*b* to 12*d* outputs the control signal of 0 V to the corresponding sub-level shifters 13*b* to 13*d* in response to the GOE signal. The sub-level shifters 13*b* to 13*d* level the control signal to the low-potential gate voltages in response to the control signal of 0 V, and then inputs them to the amplifiers 16 of the corresponding output buffers 14*b* to 14*d*. Because the control signal (in this case, 0 V) is equal to the reference value of 0 V, the comparator 15 outputs the value of "0" to the amplifiers 16 of the output buffers 14*b* to 14*d*. Accordingly, the amplifiers 16 of the output buffers 14*b* to 14*d* select the low power current corresponding to the output value of "0", and then output it to the remaining gate lines together with the low-potential gate voltage.

Second Exemplary Embodiment

Figure 5:
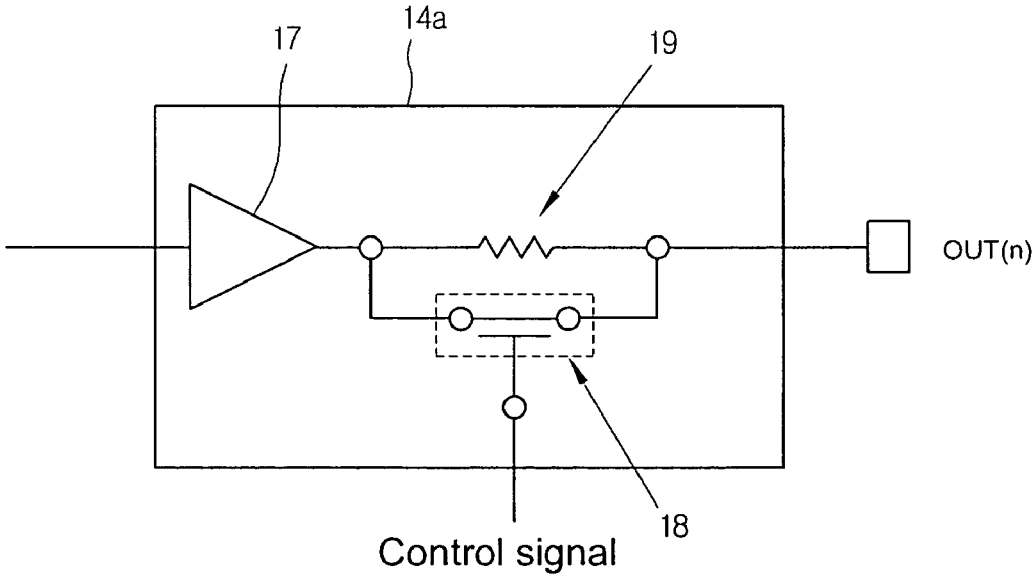
FIG. 5 is a circuit diagram of an output buffer illustrated in FIG. 3 according to another embodiment of the present invention.

FIG. 5 is a circuit diagram of an output buffer according to another embodiment of the present invention. In FIG. 5, one output buffer 14*a* among the plurality of output buffers 14*a* to 14*d* included in the buffer unit 14 is shown.

The first output buffer 14*a* includes an amplifier 17, a damper resistor 19, and a current control switch 18. The amplifier 17 amplifies a gate voltage outputted from the first sub-level shifter 13*a* and outputs a previously set output current. The damper resistor 19 is coupled to the amplifier 17 and lowers the output current by a predetermined level to output a low power current. The current control switch 18 is coupled in parallel to the damper resistor 19 and controls a path of the output current. At this point, the output current set to the amplifier 17 may be a high power current of about 10 mA.

The damper resistor 19 is an element for lowering the high power current outputted from the amplifier 17. The current control switch 18 may be a TFT switch, a FET switch and so on.

The current control switch 18 of the first output buffer 14*a* is turned on or off in response to the control signal outputted from the first flip-flop 11*a*. For example, the current control switch 18 is turned on when the control signal of 3.3 V is outputted from the first flip-flop 11*a*, and it is turned off when the control signal of 0 V is outputted. If the current control switch 18 is turned on, the high power current from the amplifier 17 is outputted to the first gate line through the current control switch 18, not through the damper resistor 19. On the contrary, if the current control switch 18 is turned off, the high power current from the amplifier 17 is lowered to the low power current through the damper resistor 19 and then outputted to the first gate line.

For this purpose, the control signal of 3.3 V from the first flip-flop 11*a* is outputted to the first AND gate 12*a* and the current control switch 18 of the first output buffer 14*a*. Accordingly, the control signal of 3.3 V passes through the first AND gate 12*a* and is converted into the high-potential gate voltage by the first sub-level shifter 13*a*, and then it is outputted to the amplifier 17 of the first output buffer 14*a*. Also, the current control switch 18 is turned on in response to the control signal of 3.3 V. Thus, the high power current from the amplifier 17 is outputted to the first gate line together with the high-potential gate voltage outputted from the first sub-level shifter 13*a*. At this point, the low-potential gate voltage is outputted to the remaining gate lines. That is, the control signal of 0 V is outputted from the flip-flops 11*b* to 11*d* except the first flip-flop 11*a*. Accordingly, the control signal of 0 V is inputted to the current control switches 18 of the output buffers 14*b* to 14*d* respectively coupled to the flip-flops 11*b* to 11*d*. The current control switches 18 are turned off in response to the control signal of 0 V. Therefore, the high power current set to the amplifier 17 passes through the damper resistor 19 and is lowered to the low power current. Also, the sub-level shifters 13*b* to 13*d* output the low-potential gate voltage to the amplifiers 17 of the corresponding output buffers 14*b* to 14*d* in response to the control signals of 0 V, which are outputted from the flip-flops 11*b* to 11*d*. Thus, the remaining output buffers output the low-potential gate voltages having the low power current to the corresponding to the gate lines.

A second exemplary case for controlling the current will now be described.

Second Case

In the second case, when the high-potential gate voltage having the low power current is outputted to a specific gate line, the low-potential gate voltage having the high power current is outputted to the remaining gate lines.

The second case will now be described with reference to FIGS. 4 and 5.

Third Exemplary Embodiment

In order to satisfy the second exemplary case, the output buffer 14*a* may be configured with the same as that of FIG. 4. However, when the output current set to the amplifier 16 is selected according to the output value of the comparator 15 illustrated in FIG. 4, the third exemplary embodiment is different from the first exemplary embodiment. That is, when the output value of the comparator 15 is "0", the high power current is selected among the output currents set to the amplifier 16. Also, when the output value is "1", the low power current is selected.

In this manner, when the control signal of 3.3 V is outputted from the first flip-flop 11*a*, the comparator 15 outputs the value of "1" in response to the control signal and the amplifier 16 outputs the low power current corresponding to the output value of "1". Also, the high-potential gate voltage is inputted from the first sub-level shifter 13*a* to the amplifier 16 in response to the control signal of 3.3 V, which is outputted from the first flip-flop 11*a*. Accordingly, the first output buffer 14*a* outputs the high-potential gate voltage having the low power current to the first gate line.

When the 3.3 V control signal is outputted from the first flip-flop 11*a*, the remaining flip-flops 11*b* to 11*d* may not output that control signal. Rather, they may output a control signal of 0 V. The comparator 15 outputs the value of "0" in response to the control signal of 0 V, and the amplifier 16 outputs the high power current corresponding to the output value of "0". Also, the low-potential gate voltage is outputted from the first sub-level shifter 13*a* to the amplifier 16 in response to the 0 V control signal. Accordingly, the first output buffer 14*a* outputs the low-potential gate voltage having the high power current to the first gate line.

As a result, in the embodiment 1, the output current selected according to the output value of the comparator 15 is selected in a manner opposite that of the first exemplary embodiment. That is, when the high-potential gate voltage having the low power current is outputted to the first gate line, the low-potential gate voltage having the high power current is outputted to the remaining gate lines.

Fourth Exemplary Embodiment

In order to satisfy the second case, the output buffer 14*a* may be configured with the same as that of FIG. 5. However, the current control switch 18 must operate in a manner opposite that of the embodiment 2. That is, the current control switch 18 of FIG. 5 is turned off in response to the 3.3 V control signal and turned on in response to the 0 V control signal. At this point, the high power current is set to the amplifier 17. Accordingly, the control signal of 3.3 V is outputted from the first flip-flop 11*a*. The control signal of 0 V is outputted from the remaining flip-flops 11*d* to 11*d*. Thus, the current control switch 18 is turned off in response to the control signal of 3.3 V, which is outputted from the first flip-flop 11*a*, and the high power current from the amplifier 17 is lowered to the low power current by the damper resistor 19. If the control signal of 0 V is outputted from the first flip-flop 11*a*, the current control switch is turned on in response to the control signal of 0 V. The high power current from the amplifier 17 is outputted through the current control switch 19.

Meanwhile, the first sub-level shifter 13*a* outputs the high-potential gate voltage to the amplifier 17 in response to the control signal of 3.3 V, which is outputted from the first flip-flop 11*a*. Accordingly, the first output buffer 14*a* outputs the high-potential gate voltage having the low power current to the first gate line. At this point, the remaining output buffers output the low-potential gate voltage having the high power current to the gate lines. That is, when the control signal of 3.3 V is outputted from the first flip-flop 11*a*, the control signals of 0 V are outputted from the remaining flip-flops 11*b* to 11*d*. The low-potential gate voltages are leveled by the corresponding sub-level shifters 13*b* to 13*d* in response to the control signals of 0V and then outputted to the amplifiers 17 of the corresponding output buffers 14*b* to 14*d*. Also, the current control switches 18 of the output buffers 14*b* to 14*d* are turned on in response to the control signals of 0 V. The low-potential gate voltages having the high power current, which are outputted from the amplifiers 17 of the output buffers 14*b* to 14*d*, are outputted to the corresponding gate lines through the current control switches 18 of the output buffers 14*b* to 14*d*.

As described above, the variation of the low-potential gate voltage is suppressed by changing the current outputted from the output terminal of the gate driver, thereby preventing the crosstalk.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A liquid crystal display device comprising:

a liquid crystal panel having crossing gate lines and data lines, the gate lines and the data lines defining pixels and including liquid crystal layer;

a gate driver for providing scan signals to the gate lines of the liquid crystal panel; and a data driver for providing video data to the data lines of the liquid crystal panel, wherein the gate driver outputs a high-potential gate voltage to one gate line and outputs a low-potential gate voltage to the remaining gate lines, wherein the gate driver regulates that an output current of the low-potential gate voltage output to the remaining gate lines is different from that of the high-potential gate voltage output to the one gate; and wherein the gate driver includes:

a gate shift register configured with a plurality of flip-flops for sequentially outputting predetermined control signals, each control signal being supplied to the corresponding AND gate and the corresponding output buffer;

an AND operation unit configured with a plurality of AND gates corresponding to the plurality of flip-flops, for controlling the output of the control signals sequentially outputted from the flip-flops in response to a gate output enable signal;

a level shifter configured with a plurality of sub-level shifters corresponding to the plurality of AND gates, for leveling a predetermined voltage according to the output signals of the AND gates; and a buffer unit configured with a plurality of output buffers corresponding to the plurality of sub-level shifters, for outputting the leveled voltages having different output current including high power current and low power current in response to the control signals sequentially outputted from the flip-flops, the different output current being set to each output buffer and one output current of the different output current being selected by each gate start pulse.

2. The liquid crystal display device according to claim 1, wherein the leveled voltage is one of a low-potential gate voltage and a high-potential gate voltage.

3. The liquid crystal display device according to claim 1, wherein each of the output buffers includes:

a comparator for comparing the control signal supplied from each flip flop with a reference value and outputting a predetermined output value; and an amplifier coupled to the comparator for outputting a leveled voltage having an output current selected depending on the output value of the comparator, wherein the comparator controls the selection of one output current of the difference output current.

4. The liquid crystal display device according to claim 3, wherein different output currents are set to the amplifiers.

5. The liquid crystal display device according to claim 1, each of the output buffers includes:

an amplifier amplifying the leveled voltage, a high power current being previously set to the amplifier;

a lowering means resistor coupled to the amplifier lowering the high power current to a low power current; and a switch coupled in parallel to the lowering means controlling a path of the high power current.

6. The liquid crystal display device according to claim 5, wherein the lowering means is a damper resistor.

7. The liquid crystal display device according to claim 5, wherein the switch is controlled in response to the control signal.

8. The liquid crystal display device according to claim 1, wherein the control signals are classified into a first control signal of a high level and a second control signal of a low level, the first control signal being outputted from only one flip-flop among the plurality of flip-flops, the second control signal being outputted from the remaining flip-flops.

9. The liquid crystal display device according to claim 8, wherein one output buffer among the plurality of output buffers outputs a high-potential gate voltage having a low power current in response to the first control signal, and the remaining output buffers output a low-potential gate voltage having a high power current in response to the second control signal.

10. The liquid crystal display device according to claim 8, wherein one output buffer among the plurality of output buffers outputs a high-potential gate voltage having a high power current in response to the first control signal, and the remaining output buffers output a low-potential gate voltage having a low power current in response to the second control signal.

11. The liquid crystal display device according to claim 1, wherein each of the plurality of output buffers outputs a high-potential gate voltage having a low power current in response to the first control signal and outputs a low-potential gate voltage having a high power current in response to the second control signal.

12. The liquid crystal display device according to claim 1, wherein each of the plurality of output buffers outputs a high-potential gate voltage having a high power current in response to the first control signal and outputs a low-potential gate voltage having a low power current in response to the second control signal.

13. A method for driving a liquid crystal display device having a gate driver including a gate shift register configured with a plurality of flip-flops sequentially outputting gate start pulses, an AND operation unit configured with a plurality of AND gates corresponding to the plurality of flip-flops controlling the output of the gate start pulses sequentially outputted from the flip-flops in response to a gate output enable signal, a level shifter configured with a plurality of sub-level shifters corresponding to the plurality of AND gates leveling the output signals of the AND gates to a predetermined voltage, and a buffer unit configured with a plurality of Output buffers corresponding to the plurality of sub-level shifters, the method comprising:

generating first and second drive control signals using a synchronization signal contained in video data, the drive control signals including a gate shift clock, a gate start pulse and a gate output enable signal;

outputting a predetermined gate voltage to gate lines of a liquid crystal panel in response to the first drive control signal;

providing the video data to data lines of the liquid crystal panel in response to the second drive control signal; and displaying the video data according to scan signal, wherein each gate start pulse is supplied to the corresponding AND gate and the corresponding output buffer, wherein if a high-potential gate voltage is outputted to one gate line, a low-potential gate voltage is outputted to the remaining gate lines, an output current of the low-potential gate voltage output to the remaining gate lines being different from that of the high-potential gate voltage output to the one gate line, wherein the different output current are set to each output buffer, and one output current of the different output current are selected by each gate start pulse.

14. The method according to claim 13, wherein the operation of outputting the predetermined gate voltage comprises:

outputting the gate start pulse in response to the gate shift clock;

leveling a predetermined voltage according to the gate start pulse;

selecting different output currents depending on the gate start pulse; and outputting the leveled voltages having the selected output currents.

15. The method according to claim 14, wherein the leveled voltage is one of the low-potential gate voltage and the high-potential gate voltage.

16. The method according to claim 13, wherein the high-potential gate voltage having a low power current is outputted to one gate line, and the low-potential gate voltage having a high power current is outputted to the remaining gate lines.

17. The method according to claim 13, wherein the high-potential gate voltage having a high power current is outputted to one gate line, and the low-potential gate voltage having a low power current is outputted to the remaining gate lines.

18. A gate driver for driving a liquid crystal panel having gate lines and data lines, the gate lines and the data lines defining pixels, the gate driver comprises:

a gate shift register configured with a plurality of flip-flops sequentially outputting predetermined control signals, each control signal being supplied to the corresponding AND gate and the corresponding output buffer;

an AND operation unit configured with a plurality of AND gates corresponding to the plurality of flip-flops controlling the output of the control signals sequentially outputted from the flip-flops in response to a gate output enable signal;

a level shifter configured with a plurality of sub-level shifters corresponding to the plurality of AND gates leveling the output signals of the AND gates to a predetermined voltage; and a buffer unit configured with a plurality of output buffers corresponding to the plurality of sub-level shifters outputting the leveled voltages having different output current in response to the control signals sequentially outputted from the flip-flops, wherein the buffer unit regulates that the leveled voltages have different output current including high power current and low power current; and wherein the different output current are set to each output buffer, and one output current of the different output current are selected by each gate start pulse.

19. The gate driver according to claim 18, wherein the leveled voltage is one of a low-potential gate voltage and a high-potential gate voltage.

20. The gate driver according to claim 18, wherein the plurality of output buffers correspond to the gate lines of the liquid crystal panel, and if a high-potential gate voltage is outputted from one of the plurality of output buffers, a low-potential gate voltage is outputted from the remaining output buffers, an output current of the low-potential gate voltage being different from that of the high-potential gate voltage.

21. The gate driver according to claim 18, wherein the control signals are classified into a first control signal of a high level and a second control signal of a low level, the first control signal being outputted from only one flip-flop among the plurality of flip-flops, the second control signal being outputted from the remaining flip-flops.

22. The gate driver according to claim 21, wherein one output buffer among the plurality of outpui buffers outputs a high-potential gate voltage having a low power current in response to the first control signal, and the remaining output buffers output a low-potential gate voltage having a high power current in response to the second control signal.

23. The gate driver according to claim 21, wherein one output buffer among the plurality of output buffers outputs a high-potential gate voltage having a high power current in response to the first control signal, and the remaining output buffers output a low-potential gate voltage having a low power current in response to the second control signal.

24. The gate driver according to claim 18, wherein the plurality of output buffers output a high-potential gate voltage having a low power current in response to the first control signal and output a low-potential gate voltage having a high power current in response to the second control signal.

25. The gate driver according to claim 18, wherein the plurality of output buffers output a high-potential gate voltage having a high power current in response to the first control signal and output a low-potential gate voltage having a low power current in response to the second control signal.

* * * * *